US012435501B2

(12) United States Patent
Kumagai et al.

(10) Patent No.: US 12,435,501 B2
(45) Date of Patent: Oct. 7, 2025

(54) INFORMATION PROCESSING APPARATUS, INFORMATION PROCESSING METHOD, AND NON-TRANSITORY COMPUTER-READABLE MEDIUM

(71) Applicant: PARAMOUNT BED CO., LTD., Tokyo (JP)

(72) Inventors: Junpei Kumagai, Kanagawa (JP); Keita Yamaguchi, Kanagawa (JP); Ikuhiro Aota, Kanagawa (JP); Hiroshi Katayanagi, Kanagawa (JP); Kazutoshi Ohishi, Kanagawa (JP); Takeshi Yamamoto, Kanagawa (JP); Hirokazu Kobayashi, Kanagawa (JP); Takeyoshi Obara, Kanagawa (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 70 days.

(21) Appl. No.: 18/684,283

(22) PCT Filed: Jul. 4, 2022

(86) PCT No.: PCT/JP2022/026601
§ 371 (c)(1),
(2) Date: Feb. 16, 2024

(87) PCT Pub. No.: WO2023/032460
PCT Pub. Date: Mar. 9, 2023

(65) Prior Publication Data

US 2024/0426092 A1 Dec. 26, 2024

(30) Foreign Application Priority Data

Aug. 30, 2021 (JP) ..... 2021-140225

(51) Int. Cl.
*E03D 9/00* (2006.01)
*A47K 13/24* (2006.01)

(52) U.S. Cl.
CPC ..... *E03D 9/00* (2013.01); *A47K 13/24* (2013.01)

(58) Field of Classification Search
CPC ..... E03D 9/00; E03D 5/105; A47K 13/24; A47K 17/00
(Continued)

(56) References Cited

U.S. PATENT DOCUMENTS

2019/0318655 A1 10/2019 Snir

FOREIGN PATENT DOCUMENTS

CN 109958175 B * 2/2021 ..... E03D 11/02
JP H09-90054 A 4/1997
(Continued)

OTHER PUBLICATIONS

International Search Report for PCT Application No. PCT/JP2022/026601, mailed on Aug. 30, 2022.
(Continued)

*Primary Examiner* — Lori L Baker
(74) *Attorney, Agent, or Firm* — Wenderoth, Lind & Ponack, L.L.P.

(57) ABSTRACT

An information processing apparatus includes a housing in which a distance sensor is placed, fittings attaching the housing to a toilet bowl in a toilet, and a control unit. The sensor measures the distance to an object located in a direction of the inside of a toilet seat installed on the bowl when the seat is placed on the top surface of a rim of the bowl. The control unit detects that a user of the toilet is in a state of sitting on the seat when a first distance being a result of measurement by the sensor is less than a predetermined threshold value. The fittings are components attach-
(Continued)

ing the housing in such a way that the sensor is placed at a position located inside the rim and located under the seat in the vertical direction when the seat is placed on the top surface of the rim.

17 Claims, 10 Drawing Sheets

(58) Field of Classification Search
USPC ..... 4/661
See application file for complete search history.

(56) References Cited

FOREIGN PATENT DOCUMENTS

| | | | | | |
|---|---|---|---|---|---|
| JP | H10-168979 | A | | 6/1998 | |
| JP | 2001-317109 | A | | 11/2001 | |
| JP | 2002-364053 | A | | 12/2002 | |
| JP | 2008081962 | A | * | 4/2008 | |
| JP | 2018-528413 | A | | 9/2018 | |
| JP | 2021-055523 | A | | 4/2021 | |
| JP | 2023125307 | A | * | 9/2023 | ..... A61B 5/6891 |
| JP | 2025056929 | A | * | 4/2025 | ..... A61B 5/6891 |
| WO | 2021/024584 | A1 | | 2/2021 | |
| WO | WO-2021060208 | A1 | * | 4/2021 | ..... A61B 5/6891 |

OTHER PUBLICATIONS

JP Office Action for JP Application No. 2021-140225, mailed on Aug. 22, 2023 with English Translation.

* cited by examiner

INFORMATION PROCESSING APPARATUS, INFORMATION PROCESSING METHOD, AND NON-TRANSITORY COMPUTER-READABLE MEDIUM

This application is a National Stage Entry of PCT/JP2022/026601 filed on Jul. 4, 2022, which claims priority from JP Patent Application 2021-140225 filed on Aug. 30, 2021, the contents of all of which are incorporated herein by reference, in their entirety.

TECHNICAL FIELD

The present disclosure relates to an information processing apparatus, an information processing method, and a program.

BACKGROUND ART

With regard to a toilet, Patent Literature 1 describes a technology for collecting excretion information indicating a content of an excretion excreted into a toilet bowl without the need for gathering information from a user of a toilet through an inquiry, and even when a foreign matter other than an excretion exists in the toilet bowl, not flushing away the foreign matter.

In the technology described in Patent Literature 1, in order to detect a user sitting on or leaving a toilet seat, a distance sensor measuring the distance to the buttocks of a user is provided inside a rim of a toilet bowl, or a weight sensor is provided on the toilet seat.

CITATION LIST

Patent Literature

[Patent Literature 1] International Patent Publication No. WO 2021/024584

SUMMARY OF INVENTION

However, while a weight sensor needs to be incorporated into a toilet seat when a weight sensor is used for detecting sitting of a user of a toilet, a weight sensor cannot be incorporated into a commercially available toilet bowl afterward, and a dedicated product needs to be developed for each type of toilet bowl and/or toilet seat for sitting detection. Further, since the distance sensor described in Patent Literature 1 is placed inside a rim of a toilet bowl, cleaning work for removing soil due to excretion is required; and therefore, a technology for facilitating the cleaning work is desired.

An object of the present disclosure is to provide an information processing apparatus, an information processing method, and a program that enable detection of sitting on a toilet seat of any already available toilet bowl and facilitate cleaning work on a detecting sensor.

An information processing apparatus according to a first aspect of the present disclosure includes: a distance sensor configured to measure a distance to an object located in a direction of an inside of a toilet seat installed on a toilet bowl in a toilet when the toilet seat is placed on a top surface of a rim of the toilet bowl; and a housing in which the distance sensor is placed. The information processing apparatus includes: a fitting configured to attach the housing to the toilet bowl; and a control unit, wherein the control unit detects that a user of the toilet is in a state of sitting on the toilet seat when a first distance being a result of measurement by the distance sensor is less than a predetermined threshold value. The fitting is a component attaching the housing in such a way that the distance sensor is placed at a position located inside the rim and located under the toilet seat in a vertical direction when the toilet seat is placed on a top surface of the rim.

An information processing method according to a second aspect of the present disclosure includes measuring, by a distance sensor, a distance to an object located in a direction of an inside of a toilet seat installed on a toilet bowl in a toilet when the toilet seat is placed on a top surface of a rim of the toilet bowl in a state of attaching, by a fitting, a housing in which the distance sensor is placed in such a way that the distance sensor is placed at a position located inside the rim and located under the toilet seat in a vertical direction when the toilet seat is placed on a top surface of the rim. The information processing method includes detecting that a user of the toilet is in a state of sitting on the toilet seat when a first distance being a result of measurement by the distance sensor is less than a predetermined threshold value.

A program according to a third aspect of the present disclosure is a program causing a computer to execute processing. The processing is executed in a state of attaching, by a fitting, a housing in which a distance sensor is placed, in such a way that the distance sensor is placed at a position located inside a rim of a toilet bowl in a toilet and located under the toilet seat in a vertical direction when a toilet seat installed on the toilet bowl is placed on a top surface of the rim. The processing receives a first distance being a result of measuring, by the distance sensor, a distance to an object located in a direction of an inside of the toilet seat when the toilet seat is placed on a top surface of the rim. The processing detects that a user of the toilet is in a state of sitting on the toilet seat when the first distance is less than a predetermined threshold value.

The present disclosure can provide an information processing apparatus, an information processing method, and a program that enable detection of sitting on a toilet seat of any already available toilet bowl and facilitate cleaning work on a detecting sensor.

EXAMPLE EMBODIMENT

Example embodiments will be described below with reference to drawings. Note that, in the example embodiments, the same or equivalent components may be given the same signs, and redundant description thereof is omitted as appropriate.

First Example Embodiment

Figure 1:
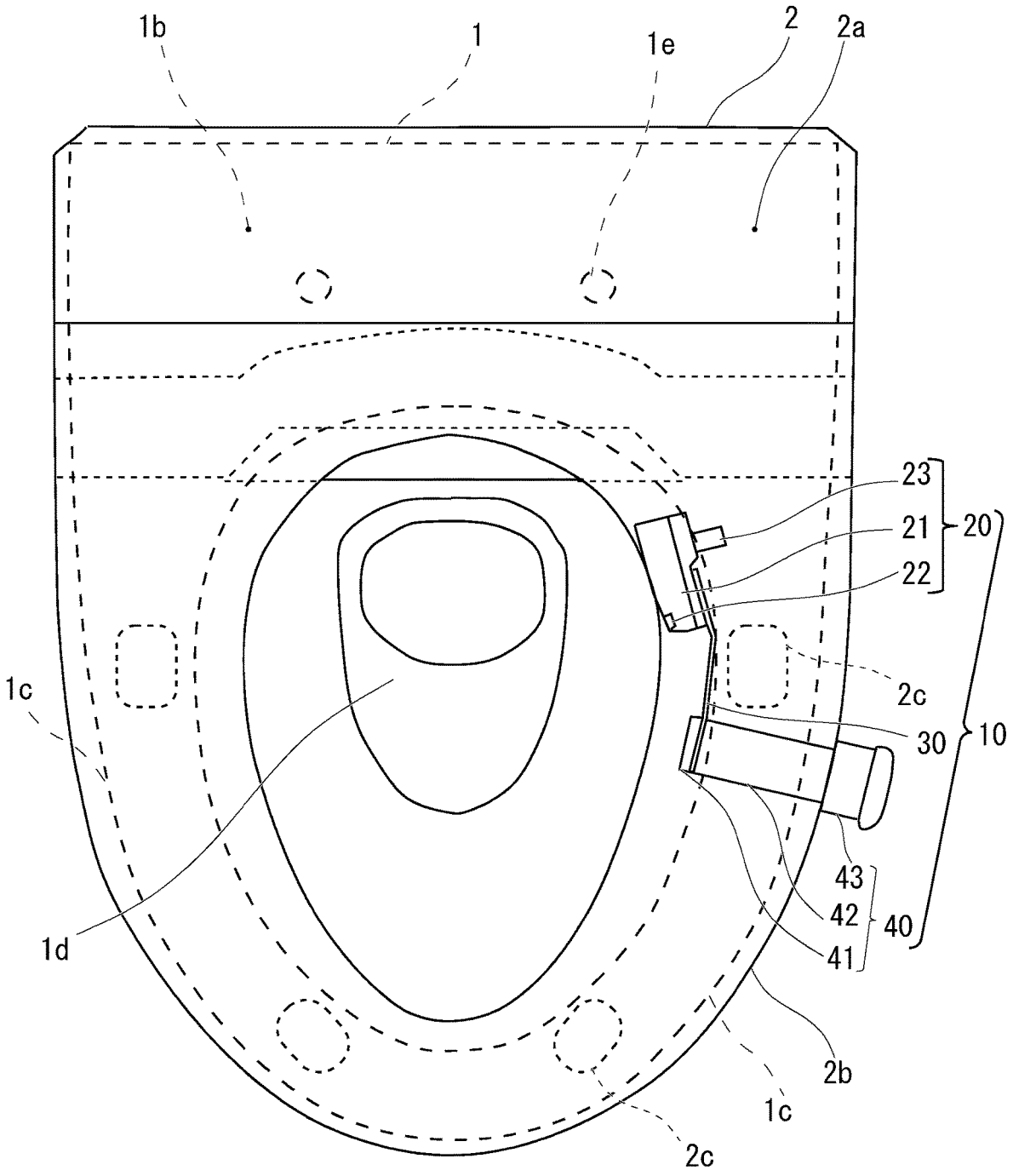
FIG. 1 is a top view illustrating a configuration example of a toilet bowl in which an information processing apparatus according to a first example embodiment is installed.

A first example embodiment will be described with reference to FIG. 1. FIG. 1 is a top view illustrating a configuration example of a toilet bowl in which an information processing apparatus according to the first example embodiment is installed.

As illustrated in FIG. 1, an information processing apparatus 10 according to the present example embodiment is installed in a toilet bowl 1 in a toilet and may include a distance sensor 22, a housing 21, fittings 30 and 40, and a control unit (unillustrated).

The toilet bowl 1 may include a rim 1*c* for forming a reservoir part 1*d* between sides thereof and may also include a plane part 1*b* continuing from the rim 1*c*. A toilet seat 2 may be installed on the plane part 1*b*. For example, an attachment part 1*e* formed of a recessed part or a hole for attaching the toilet seat 2 is formed on the plane part 1*b*, and the toilet seat 2 is provided with a projecting part in a shape engaging with the attachment part 1*e*. Alternatively, the toilet seat 2 can be attached to the toilet bowl 1 with a rod-shaped member in a shape engaging with the attachment part 1*e* interposed therebetween.

The toilet seat 2 can be thus attached to the plane part 1*b*. The toilet seat 2 may include an attachment part 2*a* attached to a position related to the plane part 1*b*, and a toilet seat body 2*b* attached to the attachment part 2*a* by a hinge in such a way as to allow contact with and separation from the top surface of the rim 1*c* of the toilet bowl 1. Furthermore, the toilet seat 2 may include a projecting part 2*c* attached on the back side of the toilet seat body 2*b* (the back side of the seat surface). In other words, the toilet seat 2 may be openably and closably installed in such a way as to come in contact with the top surface of the rim 1*c* at the projecting part 2*c* when a user uses the toilet seat 2. Note that the toilet bowl 1 and the toilet seat 2 are not limited to those illustrated and the shapes thereof are not considered relevant. Further, the shape of the toilet seat 2 installable on the toilet bowl 1 is not limited to one, and an installer may select and install an appropriate toilet seat.

The distance sensor 22 measures the distance to an object located in a direction of the inside of the toilet seat 2. A measurement may be performed at least when the toilet seat 2 installed on the toilet bowl 1 is placed on the top surface of the rim 1*c* of the toilet bowl 1. A ranging method used in the distance sensor 22 is not considered relevant, and, for example, an infrared sensor, an ultrasonic sensor, or an optical sensor may be employed as the distance sensor 22. When an optical sensor is employed, a transmission-reception element may be placed in the distance sensor 22 in such a way as to enable transmission and reception of light (not being limited to visible light) from a hole provided in the inner housing 21. The transmission-reception element may include a transmission element and a reception element separately or may include the elements in an integrated manner. Note that a switch for detecting that the toilet seat 2 is placed on the top surface of the rim 1*c* by depression by the back side of the toilet seat 2 (or for performing the detection and operating the distance sensor 22) may be provided in the housing 21 where the distance sensor 22 is placed.

An object being a measurement target of the distance sensor 22 is the buttocks of a user, and, as a matter of course, an object being a measurement target does not exist or the object is a distant wall, a ceiling, or the like when a user does not use the toilet. Further, the distance sensor 22 may also be referred to as a range sensor.

The housing 21 is a housing for placing the distance sensor 22 by including the entire distance sensor 22 or a part thereof such as a part other than the sensor surface, and the placement part 23 placed on the top surface of the rim 1*c* of the toilet bowl 1 is also placed in the housing 21. The housing 21 is a housing placed inside the toilet bowl 1 and therefore is hereinafter referred to as an inner housing 21. At least the housing 21, the distance sensor 22, and the placement part 23 constitute a sensor box (sensor unit) 20.

The fittings 30 and 40 are components attaching the inner housing 21 to the toilet bowl 1. More specifically, the fittings 30 and 40 are components attaching the housing 21 in such a way that the distance sensor 22 is placed at a position located inside the rim 1*c* and located under the toilet seat 2 in the vertical direction when the toilet seat 2 is placed on the top surface of the rim 1*c*.

In other words, the entire inner housing 21 or at least the distance sensor 22 is attached by the fittings 30 and 40 in such a way as to be placed at a position located inside the rim 1*c* and located behind the toilet seat 2 placed on the top surface of the rim 1*c* when viewed from above. The fittings 30 and 40 have shapes allowing attachment of such an inner housing 21. Note that while the shape of the inner housing 21 is not considered relevant, the shape is determined to allow maintenance of the positional relation as described above relative to the toilet seat 2 in consideration of a balance with at least the fittings 30 and 40.

Figure 2:
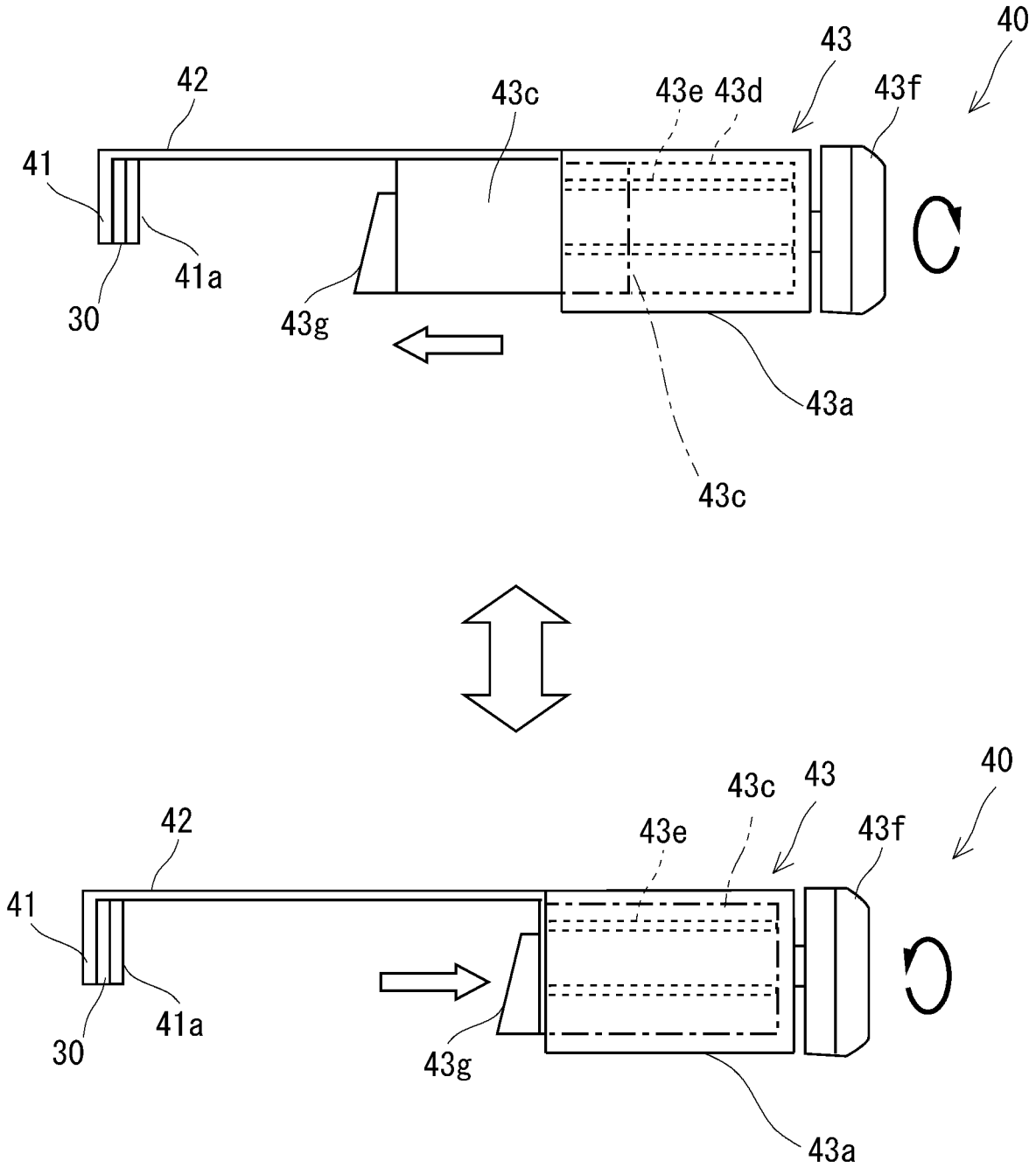
FIG. 2 is a side view illustrating an example of a fitting in the information processing apparatus in FIG. 1.

An example the fittings 30 and 40 applicable to the information processing apparatus 10 will be described with reference to FIG. 2. FIG. 2 is a side view illustrating an example of the fittings 30 and 40 in the information processing apparatus 10.

The fitting 40 is a fixing clamping mechanism fixing the fitting 30 and the inner housing 21 fixed thereto to the toilet bowl 1 by being fixed to the toilet bowl 1. As illustrated in FIG. 2, the fitting 40 may be a fixing clamping mechanism including a tip 41, a bridging part 42, and an outer housing 43.

The fixing clamping mechanism may include a connecting member such as a connecting plate bent in an L-shape, a sliding member 43*c* for clamping the rim 1*c* of the toilet bowl 1 with the tip 41, and a storage part 43*d* for sliding the sliding member 43*c* in the horizontal direction. The tip 41 and the bridging part 42 may be formed by bending a connecting member such as a connecting plate into an L-shape. The tip 41 is a member for being hooked to the rim 1*c* of the toilet bowl 1. The outer housing 43 includes a housing body 43*a*, and the housing body 43*a* also serves as a cover protecting the fixing clamping mechanism such as a fixing metal fitting. The opposite side of the bridging part 42 from the tip 41 is fixed to the housing body 43*a*.

Further, the fixing clamping mechanism may include one or a plurality of slide grooves 43*e* in the storage part 43*d* in such a way as to be able to move the sliding member 43*c* in the horizontal direction between the states in the upper diagram and the lower diagram in FIG. 2. Further, in order to adjust and fix an amount of the movement, a dial knob 43*f* is provided in the fixing clamping mechanism in such a way as to be rotatable around the sliding direction. Employment of the dial knob 43*f* enables easy attachment and detachment merely by adjustment by turning the dial with a weak force without requiring a tool. Further, use of a knob with a torque limiter as the dial knob 43*f* facilitates confirmation of normal installation. Note that an adjustment knob and a fixing member may be provided in place of the dial knob 43*f*.

Further, an elastic member 43*g* for clamping the rim 1*c* may be provided on the toilet bowl 1 side (the tip 41 side) of the sliding member 43*c*, and an elastic member 41*a* for clamping the rim 1*c* may also be provided on the housing body 43*a* side of the tip 41. The shape and the material of the elastic members 43*g* and 41*a* have only to allow firm clamping of the rim 1*c* without misalignment at the contact part with the rim 1*c*. Further, the distance between the two members has only to allow a maximum length assumed as the rim 1*c* to be secured when the sliding member 43*c* is fully stored in the storage part 43*d* (the state in the lower diagram in FIG. 2).

The bridging part 42 is a part bridging the inside of the rim 1*c* of the toilet bowl 1 and the outside of the rim 1*c* in a state of placing at least part of the bridging part 42 on the top surface of the rim 1*c* and sandwiching the rim 1*c*. The bridging part 42 is a part connecting the tip 41 to the outer housing 43 and being placed on the top surface of the rim 1*c* and may also be referred to as a horizontal part or a connecting part. Thus, the fitting 40 is fixed to the rim 1*c* at the tip 41 and the outer housing 43 by adjusting the distance to the inside of the rim 1*c* with the bridging part 42 interposed therebetween and clamping the rim 1*c*. Thus, the fitting 40 can adjust to the width of the rim 1*c*.

Further, the tip 41 is formed in such a way that the fitting 30 can be attached to the right side of the tip 41 in FIG. 2. In other words, the fitting 30 attached with the inner housing 21 can be attached to the tip 41. In this example, the elastic member 41*a* coming in contact with the rim 1*c* is provided inside the tip 41, and the fitting 30 is placed between the tip 41 and the elastic member 41*a*.

Thus, the inner housing 21 in the information processing apparatus 10 can be securely fixed and installed regardless of the shape of the toilet bowl 1, such as the shape of the rim 1*c*. Note that while an example of main components of the fixing clamping mechanism being provided in the outer housing 43 is given, the shape and the components of the fixing clamping mechanism are not considered relevant as long as the mechanism allows such fixing. Further, while an example of using a C-clamp as the fixing clamping mechanism is given in FIG. 2, the mechanism is not limited thereto.

Further, employment of such a fixing clamping mechanism enables a smaller size, a smaller number of grooves, easy wiping, and a reduced cleaning time. Further, while the fixing clamping mechanism is desirably formed of metal excluding the elastic members 43*g* and 41*a* in terms of strength, for example, the storage part 43*d* and/or the sliding member 43*c* may be formed of another material such as resin.

As can be understood from the aforementioned description, attachment/detachment of mainly the inner housing 21 in the information processing apparatus 10 to/from the toilet bowl 1 can be performed by rotating the dial knob 43*f* clockwise/counterclockwise. At attachment, the fitting 30 is attached to the tip 41, the tip 41 of the bridging part 42 (the elastic member 41*a* in practice) is hooked to the rim 1*c* of the toilet bowl 1 from the state as illustrated in the lower diagram in FIG. 2, and then the dial knob 43*f* is rotated counterclockwise for fixing. Thus, the distance between the sliding member 43*c* and the tip 41 is shortened and installation can be performed as illustrated in the upper diagram in FIG. 2. Attachment of the fitting 30 to the inner housing 21 may be performed in advance or may be performed after fixing by the aforementioned rotation. At detachment, by rotating the dial knob 43*f* clockwise for release of fixing, fixing of the structure is released as the state illustrated in the lower diagram in FIG. 2, and detachment is enabled. Use of a knob with a torque limiter as the dial knob 43*f* particularly facilitates normal installation confirmation of attachment and detachment.

As described above, by including such a fixing clamping mechanism, the information processing apparatus 10 can be simply installed in and detached from a wide variety of commercially available toilet bowls 1 without using a tool and without replacing a toilet bowl in a toilet with a dedicated product. Further, by rotating the dial knob 43*f*, the sensor box 20 can be readily attached to and detached from the toilet bowl 1 by a strong force even when a force applied in an opening-closing operation is weak. Further, an apparatus series does not need to be added for each type of toilet bowl, and an apparatus vendor can reduce the administrative cost. Further, by including the fixing clamping mechanism as described above, for example, easy detachment and reinstallation can be performed when the toilet bowl 1 is cleaned. Further, by including the fixing clamping mechanism as described above, a cleaner in a state of wearing gloves for cleaning can readily perform detachment and reinstallation, and efficiency of cleaning work can be improved.

While some types of toilets include a handrail beside a toilet bowl, the information processing apparatus 10 can be installed in such types without particularly reducing the width of the outer housing 43. Further, for example, a control box can be separately placed on the side and at the rear of the toilet bowl 1, and therefore, a component attached to the toilet bowl 1 can be installed without particularly reducing the width.

Further, without being limited to the above, examples of the fitting 40 may include a clamping mechanism installed between the side of the toilet bowl 1 and a part corresponding to the outer housing 43. The clamping mechanism may be a mechanism coming in contact with the side of the toilet bowl 1 and a surface of the part corresponding to the outer housing 43 on the toilet bowl 1 side and adjusting the length therebetween.

For example, the fitting 30 may be a plate-shaped or bar-shaped member; and one end of the fitting 30 is attached to the tip 41 of the fitting 40, and the other end is attached to the inner housing 21. Assuming the shape of the inside of the rim 1*c* of the toilet bowl 1 (roundness in the example in FIG. 1), the shape of the fitting 30 in the longitudinal direction may have a similar shape. Specifically, the fitting 30 includes an extension part shaped along an inner wall forming the inside of the rim 1*c*, and the inner housing 21 may be attached to the tip of the extension part. While an example of the fitting 30 and the fitting 40 being separate components is given and detailed example of the fitting 40 has been described, the fitting 30 may be integrally formed with the fitting 40.

The aforementioned control unit is connected to the distance sensor 22 by wired or wireless communication and controls the distance sensor 22. While the control unit may be provided in the inner housing 21, in other words, be included in the sensor box 20, the control unit may also be provided in the outer housing 43 or a separately provided housing (the aforementioned control box).

Then, the aforementioned control unit detects that a user of a toilet is in a state of sitting on the toilet seat 2 when a first distance being a result of measurement by the distance sensor 22 is less than a predetermined threshold value. Further, while the aforementioned control unit thus detects sitting, the unit may similarly detect a state of leaving the seat when the first distance becomes equal to or greater than the aforementioned predetermined threshold value after sitting detection.

For example, the aforementioned control unit may be provided by a central processing unit (CPU), a work memory, and a nonvolatile storage device in which a program is stored. For example, the program may be a program for causing the CPU to execute the processing as described above. Further, for example, the aforementioned control unit may also be provided by an integrated circuit.

Figure 3:
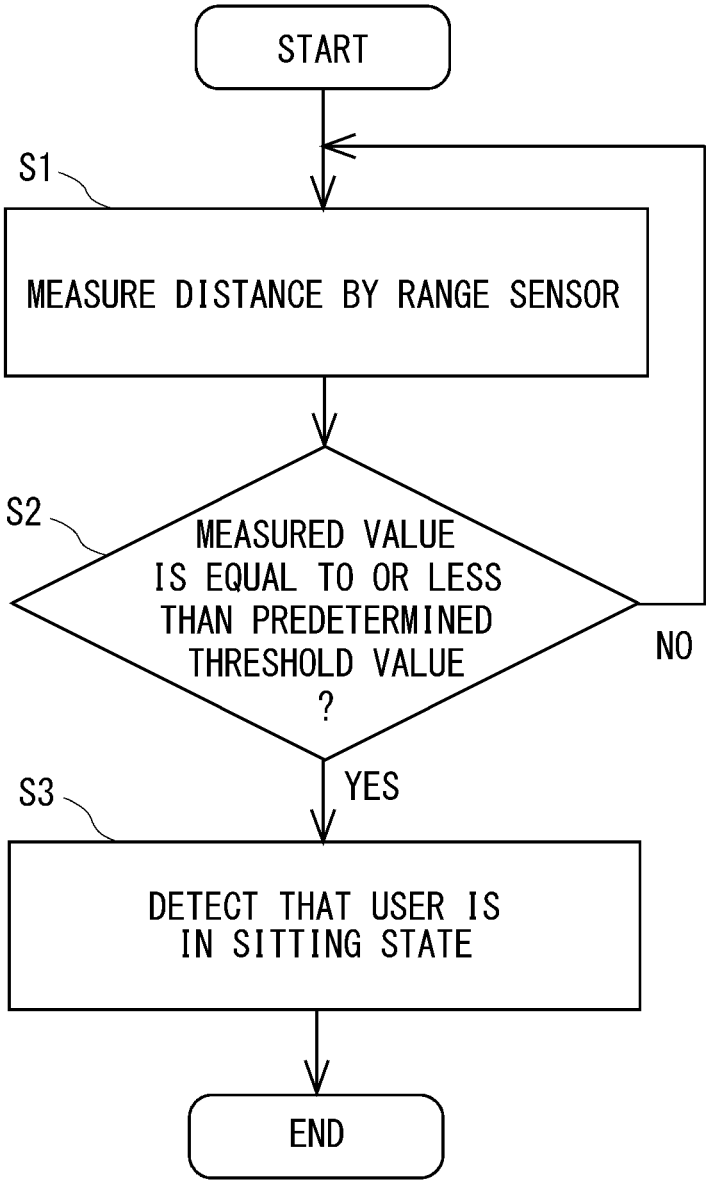
FIG. 3 is a flowchart for illustrating a processing example in the information processing apparatus in FIG. 1.
Figure 4:
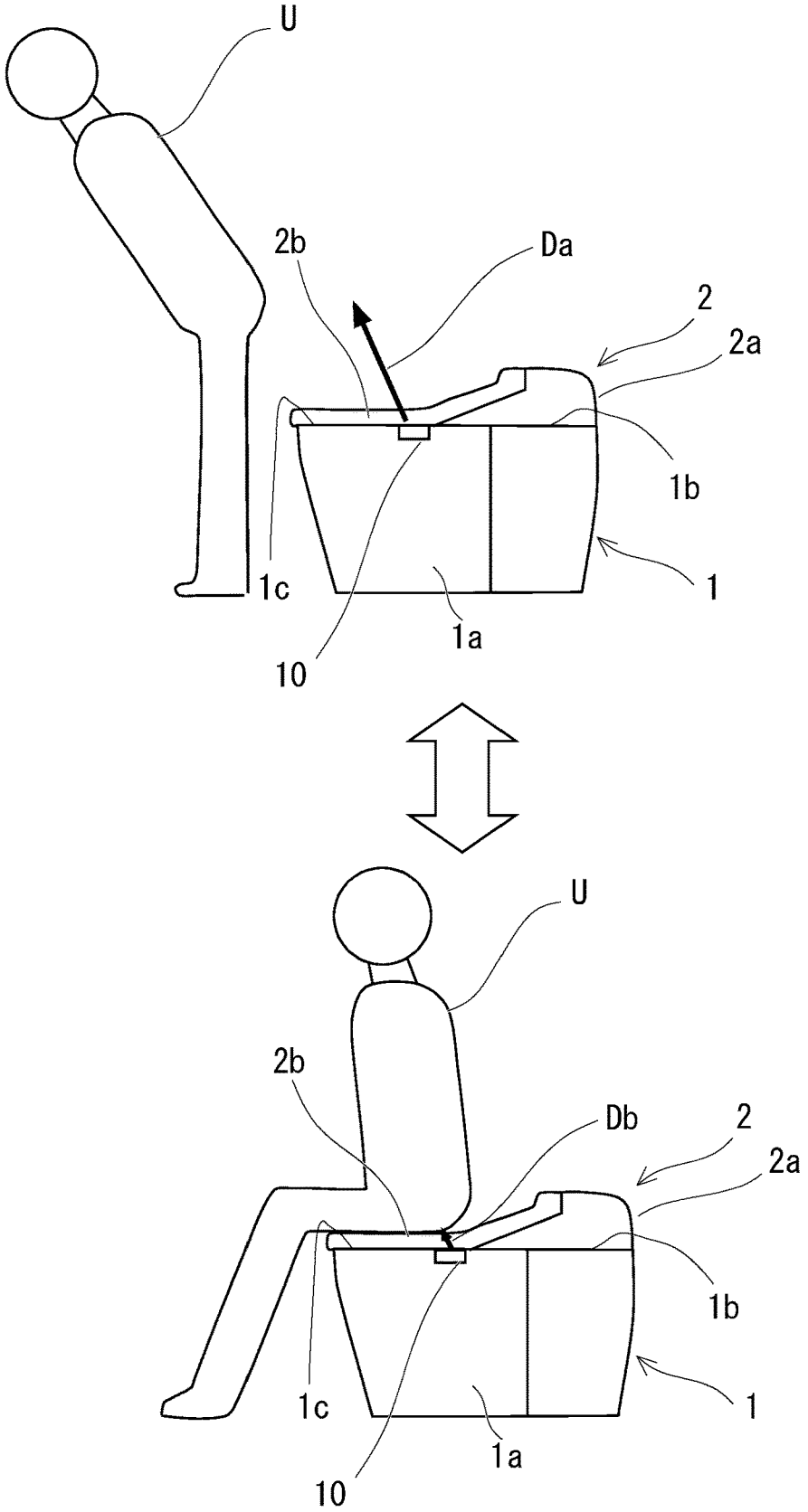
FIG. 4 is a schematic diagram for illustrating changes in a sitting state of a user in the processing example in FIG. 3.

Next, a processing example in the information processing apparatus 10 will be described with reference to FIG. 3 and FIG. 4. FIG. 3 is a flowchart for illustrating the processing example in the information processing apparatus 10, and FIG. 4 is a schematic diagram for illustrating changes in a sitting state of a user in the processing example in FIG. 3.

First, the inner housing 21 is attached by the fittings 30 and 40 in such a way that the distance sensor 22 is placed at a position located inside the rim 1*c* of the toilet bowl 1 in a toilet and located under the toilet seat 2 in the vertical direction when the toilet seat 2 is placed on the top surface of the rim 1*c*. In such a state, the distance sensor 22 measures the distance to an object located in a direction of the inside of the toilet seat 2 when the toilet seat 2 is placed on the top surface of the rim 1*c* (step S1).

Next, the control unit compares the first distance being the result of the measurement by the distance sensor 22 with a predetermined threshold value (step S2) and when the first distance is less than the predetermined threshold value (YES in step S2), detects that the user of the toilet is in a state of sitting on the toilet seat 2 (step S3). The sitting state is detected as a result of detection of the buttocks. Note that in a case of NO in step S2, the measurement in step S1 is continued. The first distance is a distance Da (for example, equal to or greater than a detectable distance) before a user U sits on the seat as illustrated in the upper diagram in FIG. 4, and the first distance is a distance Db less than the predetermined distance in a state of the user U sitting on the seat as illustrated in the lower diagram in FIG. 4; and thus sitting can be detected. Note that a side 1*a* of the toilet bowl 1 is also illustrated in FIG. 4.

As described above, the information processing apparatus 10 according to the present example embodiment does not require, for example, a weight sensor to be incorporated into the toilet seat and therefore can detect sitting on the toilet seat of any already available toilet bowl. Specifically, the information processing apparatus 10 according to the present example embodiment has a structure allowing attachment regardless of the shape of the toilet bowl 1 and therefore can be installed in toilet bowls in various shapes and, for example, can be installed without being affected by an environment of a toilet at a home of a person requiring nursing care. Therefore, the present example embodiment enables attachment to toilet bowls in various shapes without the need for increasing the number of types with varying shapes or the like of the information processing apparatus and enables minimization of the administrative cost and the manufacturing cost of the information processing apparatus.

Further, since the distance sensor is placed at a position hidden by the toilet seat, and the sensor surface in particular is placed at a position hidden by the toilet seat, the information processing apparatus 10 according to the present example embodiment can facilitate cleaning work of the distance sensor. For example, the present example embodiment can be suitably utilized in the fields of healthcare and medical nursing care in which a structure including a distance sensor deployed in a toilet bowl of a toilet may be placed.

Further, an excretion detection unit (excretion information collection unit) may be configured in the inner housing in which a distance sensor is placed, by mounting a sensor collecting information about an excretion (excretion information) of a care recipient or the like. While a specific example of such a configuration will be given in a second example embodiment, such a configuration also provides the aforementioned effect. Specifically, employment of a configuration in which a distance sensor is deployed in an excretion detection unit and the excretion detection unit is placed under the toilet seat in a fixed manner enables detection of sitting and collection of excretion information in any commercially available toilet bowl and enables facilitation of cleaning work of the distance sensor. Further, a sensor collecting such excretion information is preferably placed at a position located inside the rim of the toilet bowl and located under the toilet seat in the vertical direction when the toilet seat is placed on the top surface of the rim of the toilet bowl, similarly to the placement condition of the distance sensor.

Second Example Embodiment

Figure 5:
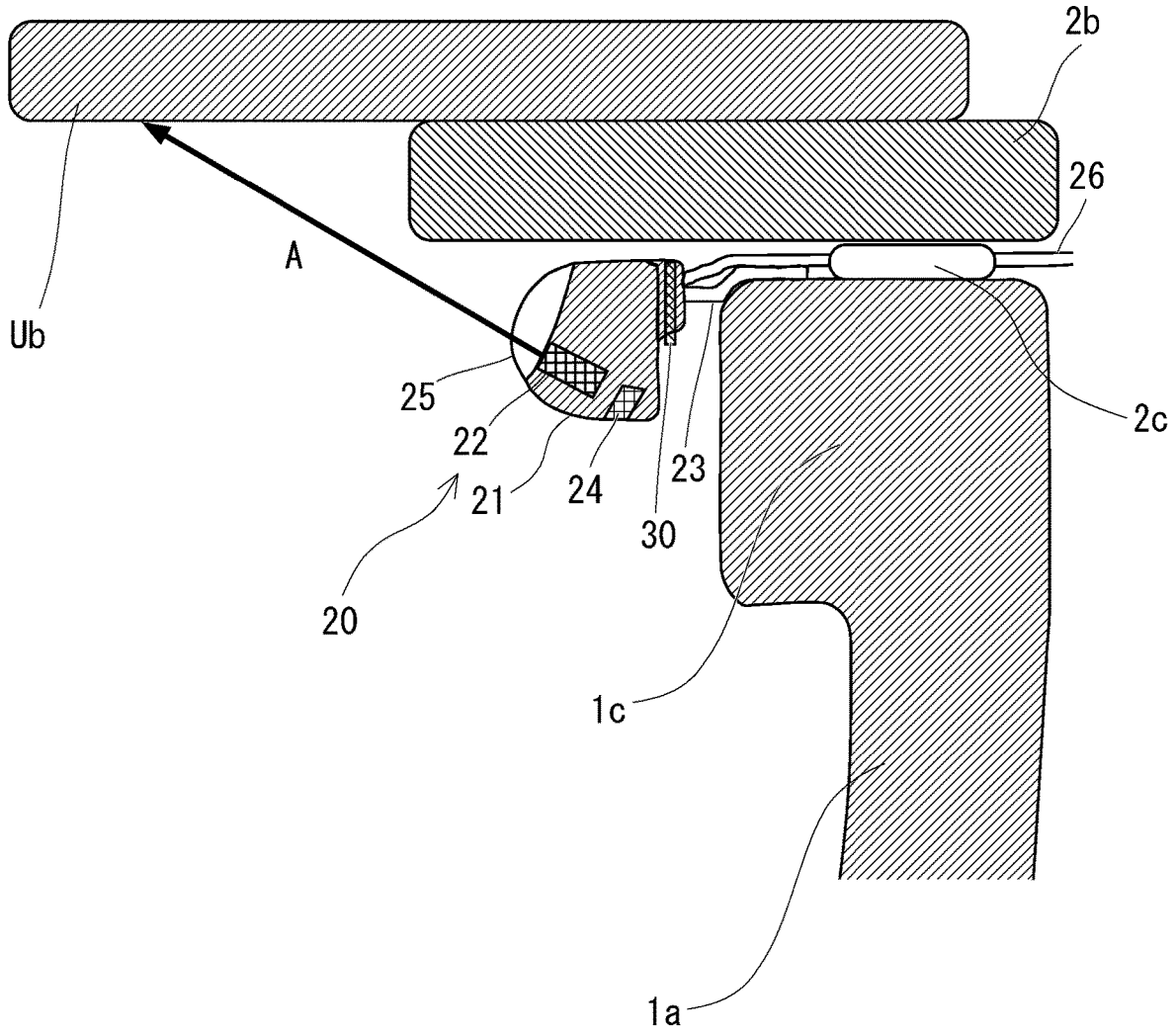
FIG. 5 is a cross-sectional view partially illustrating a configuration example of a toilet bowl in which an excretion information collection apparatus according to a second example embodiment is installed.
Figure 6:
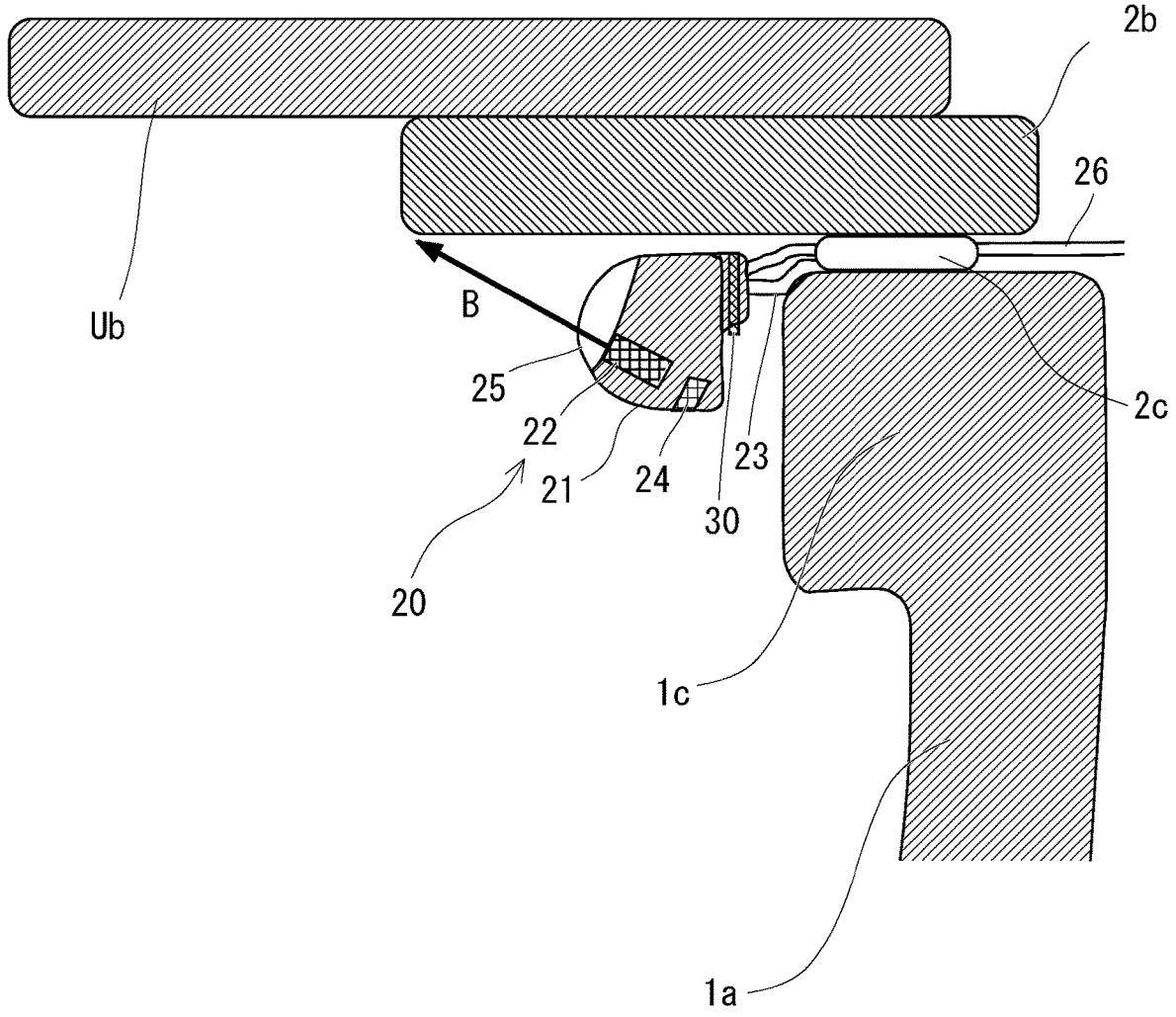
FIG. 6 is a cross-sectional view illustrating a case of a toilet seat being placed in a misaligned manner relative to a toilet bowl in the cross-sectional view in FIG. 5.
Figure 7:
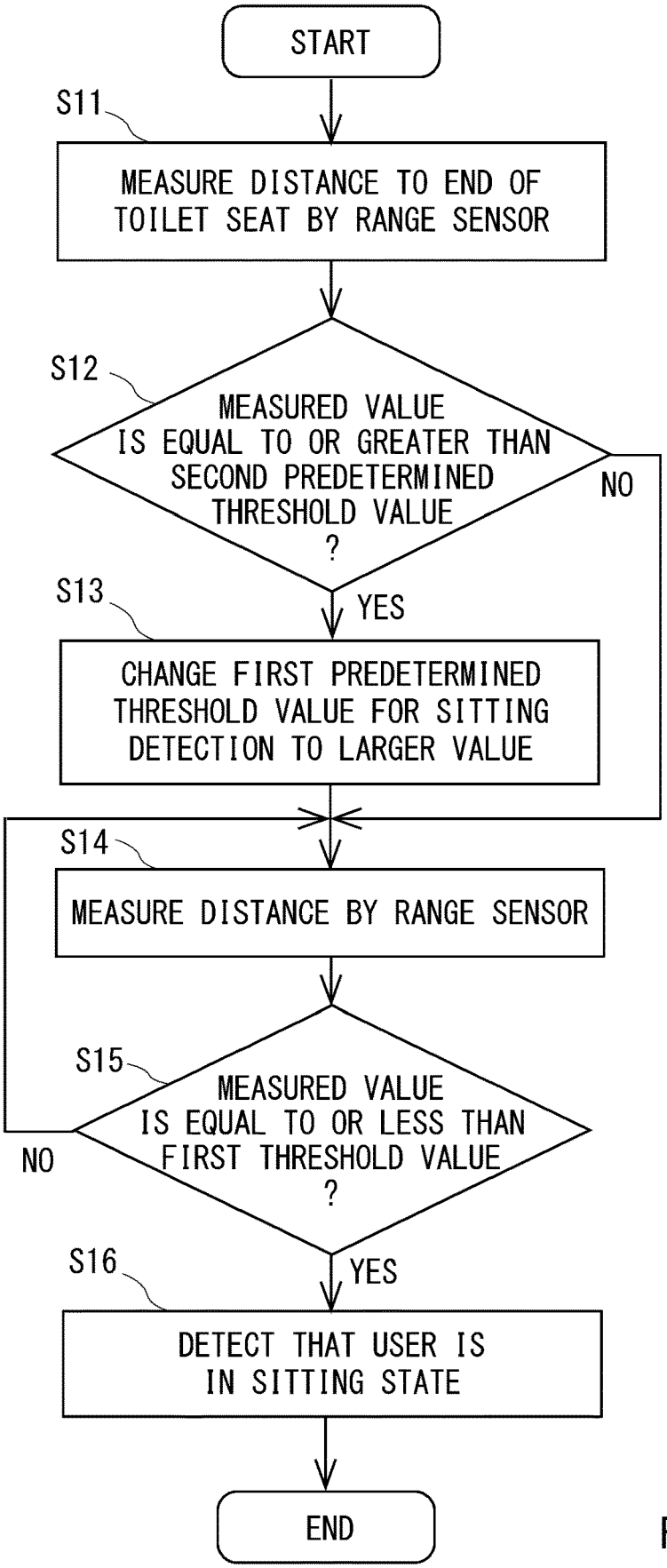
FIG. 7 is a flowchart for illustrating a processing example in the excretion information collection apparatus in FIG. 5 and FIG. 6.

While a second example embodiment will be described with reference to FIG. 5 to FIG. 7 with a particular emphasis on the difference between the second example embodiment and the first example embodiment, various examples described in the first example embodiment are applicable. First, a configuration example of an excretion information collection apparatus being an example of the information processing apparatus 10 will be described with reference to FIG. 5 and FIG. 6. FIG. 5 is a cross-sectional view partially illustrating a configuration example of a toilet bowl in which an excretion information collection apparatus according to the second example embodiment is installed. Further, FIG. 6 is a cross-sectional view illustrating a case of a toilet seat being placed in a misaligned manner relative to the toilet bowl in the cross-sectional view in FIG. 5.

An information processing apparatus according to the present example embodiment is an excretion information collection apparatus enabling collection of excretion information in the information processing apparatus 10, and, as illustrated in FIG. 5, an information collection unit 24 for the collection may be placed in an inner housing 21. The information collection unit 24 can also be controlled by a control unit. Note that the information processing apparatus according to the present example embodiment may be configured without the information collection unit 24.

FIG. 5 gives an example of placing, as the information collection unit 24, a camera in the inner housing 21 in an excreting direction of an excretion. The information collection unit 24 is a part collecting information about an excretion in a toilet bowl 1 and may be, for example, an image capture apparatus collecting a content of an excretion, such as the shape and/or the color of the excretion, through an optical lens, or a distance sensor optically measuring a distance. The excretion information may refer to information indicating a content of excretion and, in a simpler example, may refer to information indicating that excretion is feces (stool) or pee (urine). The excretion information may also include other types of information such as information indicating the color of an excretion and the shape of an excretion when the excretion is a solid matter. The information collection unit 24 may be configured to simply detect and collect existence of excretion as information about an excretion.

The information collection unit 24 may have a region including a reservoir part of the toilet bowl (an excretion area) as a collection area, and the excretion area may also be referred to as an expected excretion area. By installing the information collection unit 24 in such a way as to include such an excretion area into an image capture area, captured image data include an excretion and the like as subjects. The information collection unit 24 is placed in such a way as to be able to collect information from a gathering part (a region where an excretion is excreted) of the toilet bowl 1 by, for example, exposing the information collection surface of the information collection unit 24 from an opening of the inner housing 21. For example, a lens surface in a case of a camera and a detection surface in a case of a sensor fall under the aforementioned information collection surface. As a matter of course, the aforementioned excretion area is preferably set to an area in which a user does not appear, and the information collection unit 24 is preferably installed in such a way that the lens and the like are not visible to the user. Inclusion of the information collection unit 24 enables collection of information about an excretion excreted by a user of a toilet without the need for gathering information from the user through an inquiry. Note that a distance sensor 22 also collects information indicating a sitting state and therefore may be considered part of the information collection unit.

Further, FIG. 5 also gives an example of an attachment position of a fitting 30 to a sensor box 20 and an example of a placement part 23. Further, the inner housing 21 may also be provided with a transparent part 25 leading to the sensor surface of the distance sensor 22, which further facilitates cleaning. Further, FIG. 5 gives an example of the control unit being provided outside the sensor box 20 and being connected to a cord 26 drawn from the inner housing 21. The cord 26 is routed through a region where a projecting part 2*c* of a toilet seat body 2*b* does not exist and is taken out of the toilet bowl 1. Note that wireless communication may be used in place of the cord 26.

Then, as a main feature, the present example embodiment employs a configuration enabling not only detection of sitting but also detection of misalignment of a toilet seat 2 (misalignment of the toilet seat body 2*b* in practice). Therefore, the sensor box 20 (an excretion detection unit in this example) is installed under the toilet seat by fittings 30 and 40, similarly to the first example embodiment. The excretion information collection apparatus according to the present example embodiment detects sitting of a user of a toilet and toilet seat misalignment from distance information from the distance sensor deployed in the installed sensor box 20.

The control unit can also perform determination of detection of toilet seat misalignment. The control unit determines whether the toilet seat 2 is in a misaligned state, based on a second distance being a result of measuring, by the distance sensor 22, the distance to the inner end of the bottom surface of the toilet seat 2 when the toilet seat 2 is placed on the top surface of the rim 1*c*.

Processing of detecting sitting (detection of buttocks) and processing of detecting misalignment of the toilet seat 2 will be specifically described. As illustrated in FIG. 5, a threshold value for a first distance is set to the control unit as A [mm] for sitting detection, and a sitting state is detected when the first distance being a measured distance read from the distance sensor 22 is equal to or less than the threshold value A. As described with reference to FIG. 4, a measured distance is greater than the threshold value A before a user sits on the seat, and therefore, a sitting state is not detected; and a measured distance (the first distance) to the buttocks Ub of the user is equal to or less than the threshold value A after sitting on the seat, and therefore, a sitting state is detected.

As illustrated in FIG. 6, not only the threshold value A for detecting a sitting state but also a threshold value B [mm] as a threshold value for the first distance is separately set to the control unit for determining the distance to a misaligned toilet seat; and a misaligned toilet seat state is determined (detected) when the first distance is equal to or less than the threshold value B. The threshold value B is a threshold value for determining that, although the first distance is the distance to the inner end of the bottom surface of the toilet seat 2, a result of actual measurement indicates that the first distance is the distance to the toilet seat 2.

As illustrated in FIG. 5 and FIG. 6, the distance to a misaligned toilet seat (a distance determined by the threshold value B) is less than a distance to a sitting user (a distance determined by the threshold value A). Therefore, based on the first distance being a result of measurement by the distance sensor 22, the control unit determines that the toilet seat 2 is in a misaligned state when the first distance is less than another predetermined threshold value (the threshold value B) being a value less than the threshold value A.

Thus, by performing misaligned toilet seat detection with the threshold value B less than the threshold value A for sitting detection, the control unit does not detect sitting in a case of toilet seat misalignment and enables operation distinguishing between a sitting state and a misaligned toilet seat state. Specifically, the present example embodiment enables improved precision of sitting detection by providing, for the distance value from the distance sensor when a user is sitting being different from that when the toilet seat position is misaligned, threshold values for determining a state of sitting and a state of the toilet seat position being misaligned and detecting the states.

Further, while distances measured for performing sitting detection and toilet seat misalignment detection are defined to be the same "first distance" in the aforementioned example, the two may be distinguished by defining the former as a first distance and the latter as a second distance. In this case, the second distance can be defined as a result of measuring, by the distance sensor 22, the distance to the inner end of the bottom surface of the toilet seat 2 (the toilet seat body 2*b*) when the toilet seat 2 is placed on the top surface of the rim 1*c*. In other words, the control unit determines whether the toilet seat 2 is in a misaligned state, based on the second distance being a result of measuring, by the distance sensor 22, the distance to the inner end of the bottom surface of the toilet seat 2 when the toilet seat 2 is placed on the top surface of the rim 1*c*.

In order to perform such separate determinations, the first distance and the second distance may be predefined as distances in directions different from each other. For example, the above can be achieved by performing control of varying the orientation of the sensor surface of the distance sensor 22 between the first distance and the second distance, controlling the emission method or the emission direction of detection light or the like, or measuring a distance two-dimensionally or three-dimensionally. Alternatively, another implementation method such as including two distance sensors in the distance sensor 22 is employable.

In that case, when determining that the toilet seat 2 is in a misaligned state by measurement of the second distance and comparison with the threshold value B, the control unit may change the threshold value A for the first distance. A range of change may be set in such a way as to allow detection of sitting even when a user is sitting in a misaligned state of the toilet seat 2. An optimum value may be derived from information about actually available toilet bowls and toilet seats, and the range of change may be set to the value.

Next, a processing example of processing the first distance and the second distance separately will be described with reference to FIG. 7. FIG. 7 is a flowchart for illustrating a processing example in the excretion information collection apparatus in FIG. 5 and FIG. 6.

First, the inner housing 21 in which the distance sensor 22 is placed is attached by the fittings 30 and 40, similarly to the first example embodiment. Specifically, the attachment is performed in such a way that the distance sensor 22 is placed at a position located inside the rim 1*c* of the toilet bowl 1 in a toilet and located under the toilet seat 2 (the toilet seat body 2*b* in practice) in the vertical direction when the toilet seat 2 is placed on the top surface of the rim 1*c*.

In such a state, the distance sensor 22 measures the distance to the inner end of the bottom surface of the toilet seat 2 (the toilet seat body 2*b*) when the toilet seat 2 is placed on the top surface of the rim 1*c* (step S11). The control unit preferably uses the longest distance out of the measured distances excluding an infinite distance or the distance to the ceiling or a wall as a second distance of the measurement results. Next, the control unit compares the second distance being the result of measurement by the distance sensor 22 with a second predetermined threshold value (a threshold value B) (step S12) and determines that toilet seat misalignment has occurred when the second distance is equal to or greater than the second predetermined threshold value (YES in step S12). The threshold value B in this case may be set to a maximum value indicating a state in which toilet seat misalignment does not exit.

In a case of YES in step S12, in other words, when determining that toilet seat misalignment has occurred, the control unit changes a first predetermined threshold value (a threshold value A) to a larger value. An example of using a small value used when toilet seat misalignment does not exist and a large value used when toilet seat misalignment exists as the threshold value A is given as a simple example. However, with regard to the threshold value A, preparing three or more graduated values and selecting a threshold value A according to an amount of misalignment of the toilet seat (in other words, according to an amount of deviation from the threshold value B), or increasing a factor to be multiplied by one threshold value A according to an amount of misalignment of the toilet seat may be employed. For example, the processing in steps S11 to S13 may be preferably performed when an initial configuration of the excretion information collection apparatus is performed, before a user sits on the seat for the first time, or when a user is detected to have left the seat.

In such a state, the distance sensor 22 measures a first distance to an object located in a direction of the inside of the toilet seat 2 when the toilet seat 2 is placed on the top surface of the rim 1*c* (step S12). Note that the processing in step S12 is also performed in a case of NO in step S12.

Next, the control unit compares the first distance being the result of the measurement by the distance sensor 22 with the first predetermined threshold value (the threshold value A) (step S15). Then, when the first distance is less than the first predetermined threshold value (YES in step S15), the control unit detects a state of a user sitting on the toilet seat 2 (a state of the buttocks being detected) (step S16). Note that the measurement in step S14 is continued in a case of NO in step S15.

As described above, according to the present example embodiment, a distance sensor is deployed in the excretion detection unit on which a sensor collecting excretion information is mounted, the excretion detection unit is placed under the toilet seat in a fixed manner, and whether a user is sitting on the seat is detected from distance information from the distance sensor in consideration of toilet seat misalignment. In fact, in the method of detecting existence of a user from distance information from the distance sensor under the toilet seat, a case of not being able to accurately detect sitting may occur when the toilet seat position is misaligned. Since detection of toilet seat misalignment is also performed, the present example embodiment can provide improved precision of sitting detection in addition to the effect provided by the first example embodiment.

Further, an example of the housing 21 being provided with a switch detecting that the toilet seat 2 is placed on the top surface of the rim 1*c* by depression by the back side of the toilet seat 2 has been described in the first example embodiment. On the other hand, according to the present example embodiment enabling detection of the toilet seat 2, detection of placement of the toilet seat 2 on the top surface of the rim 1*c* can be performed without separately providing such a switch.

Third Example Embodiment

Figure 8:
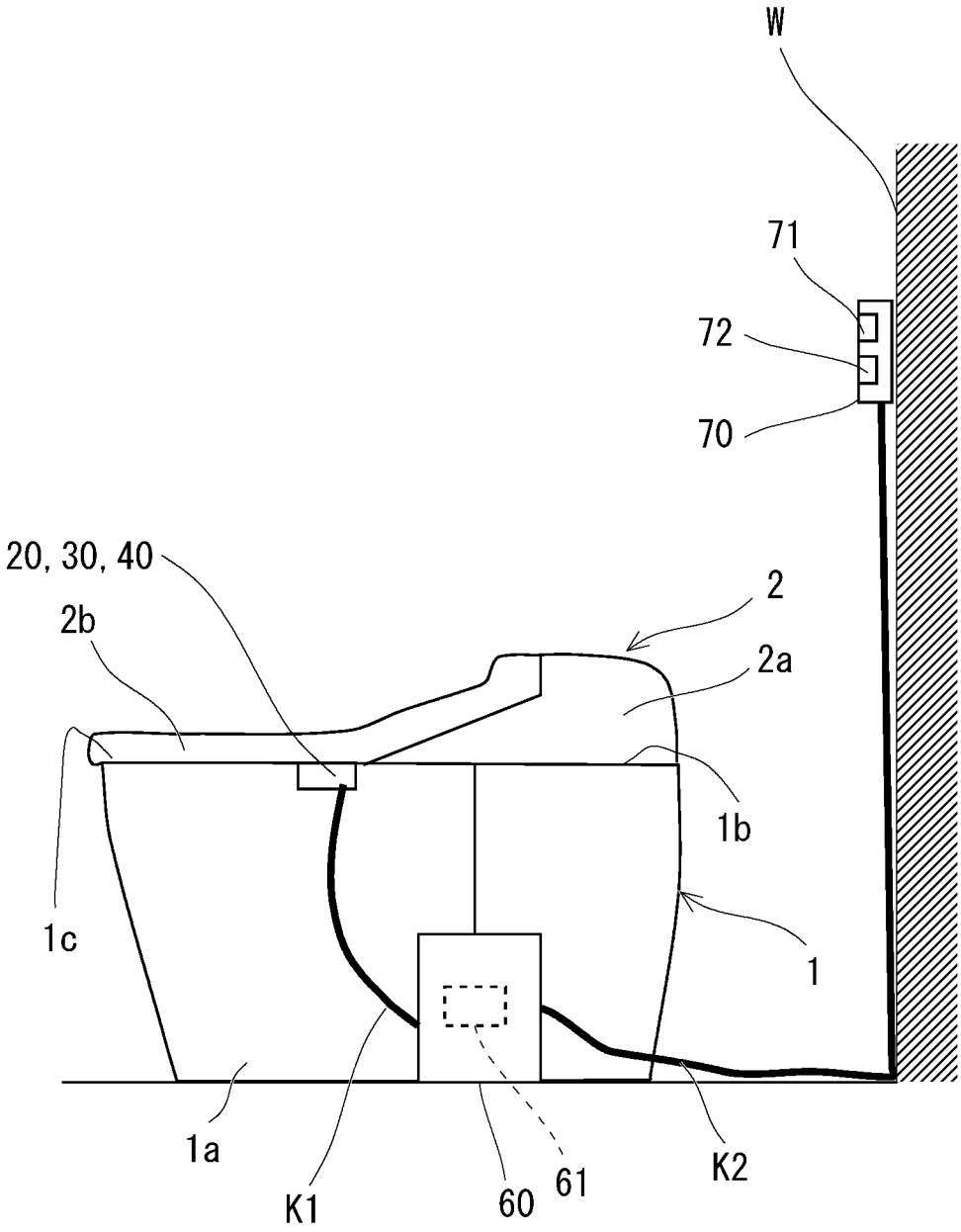
FIG. 8 is a side view illustrating a configuration example of a toilet bowl in which an excretion information collection apparatus according to a third example embodiment is installed.

While a third example embodiment will be described with reference to FIG. 8 and FIG. 9 with a particular emphasis on the difference between the third example embodiment and the second example embodiment, various examples described in the first and second example embodiments are applicable. FIG. 8 is a side view illustrating a configuration example of a toilet bowl in which an excretion information collection apparatus according to the third example embodiment is installed.

The excretion information collection apparatus according to the present example embodiment (hereinafter the present apparatus) is an apparatus acquired by providing a function of distinguishing between users and enabling management of collected excretion information for each user in the excretion information collection apparatus according to the second example embodiment.

As illustrated in FIG. 8, the present apparatus is installed in a distributed manner in or outside a toilet bowl 1, and a sensor box 20 is attached to a rim 1*c* of the toilet bowl 1 by fittings 30 and 40. The present apparatus may further include a control box 60 including a control unit 61 as the aforementioned control unit, and a human detection/identification box 70 including an image capture apparatus 71 and a human detecting sensor 72.

The image capture apparatus 71 is a device capturing an image of the face of a user of a toilet and, for example, may be a camera capturing a static image and/or a dynamic image. Further, without being limited to a visible light camera, the image capture apparatus 71 may be an infrared camera or the like. While, for example, the lens of the image capture apparatus 71 may be exposed from the human detection/identification box 70 in such a way that an image of the face of a user of the toilet can be captured, the device has only to be able to capture an image of the face.

The human detecting sensor 72 may be provided for acquiring a timing for starting the image capture apparatus 71 or capturing an image. The human detecting sensor 72 is a sensor detecting existence of a person (entrance and exit of a person) in a specific region (a measurement area of the human detecting sensor 72); and, for example, an infrared sensor, an ultrasonic sensor, or an optical sensor may be employed regardless of the detection method. While the detection surface of the human detecting sensor 72 may be exposed from the human detection/identification box 70 in such a way that a user of the toilet can be detected, the sensor has only to be able to detect a person.

An information collection unit 24 in the sensor box 20 may be a camera, and the image capture apparatus 71 may also be a camera; and the two will be referred to as a first camera 24 and a second camera 71, respectively, in the following description.

The control box 60 may be a storage housing (part of an outer housing) in which the control unit 61 is stored and may be connected to the sensor box 20 by a cable K1 (a cord 26) and be placed beside a side 1*a* of the toilet bowl 1. The control unit 61 controls a distance sensor 22 and the first camera 24 in the sensor box 20, and the second camera 71 and the human detecting sensor 72 in the human detection/identification box 70. For example, the control unit 61 can receive a detection result by the human detecting sensor 72, can instruct the second camera 71 to capture an image and receive the captured image, and can instruct the first camera 24 to collect information about an excretion and receive the collected information. While an example of the distance sensor 22, the first camera 24, the human detecting sensor 72, and the second camera 71 being connected to the control unit 61 in a wired manner is given, the components may be connected by wireless communication. Further, a CPU for analyzing information from each sensor and a WiFi interface for communicating with a server may be deployed in the control box 60.

The human detection/identification box 70 may be provided as a separate housing placed outside the outer housing, be connected to the control unit 61 in the control box 60 by a cable K2, and be placed on a wall W of the toilet (a wall located in front when the door of the toilet is opened). As a matter of course, the shapes and the placements of the control box 60 and the human detection/identification box 70 are not limited to those illustrated in FIG. 8, and, for example, the control box 60 may be installed behind the toilet bowl 1.

Next, with reference to FIG. 9, an example of control in the present apparatus will be described. FIG. 9 is a block diagram illustrating a configuration example of the excretion information collection apparatus in FIG. 8.

Figure 9:
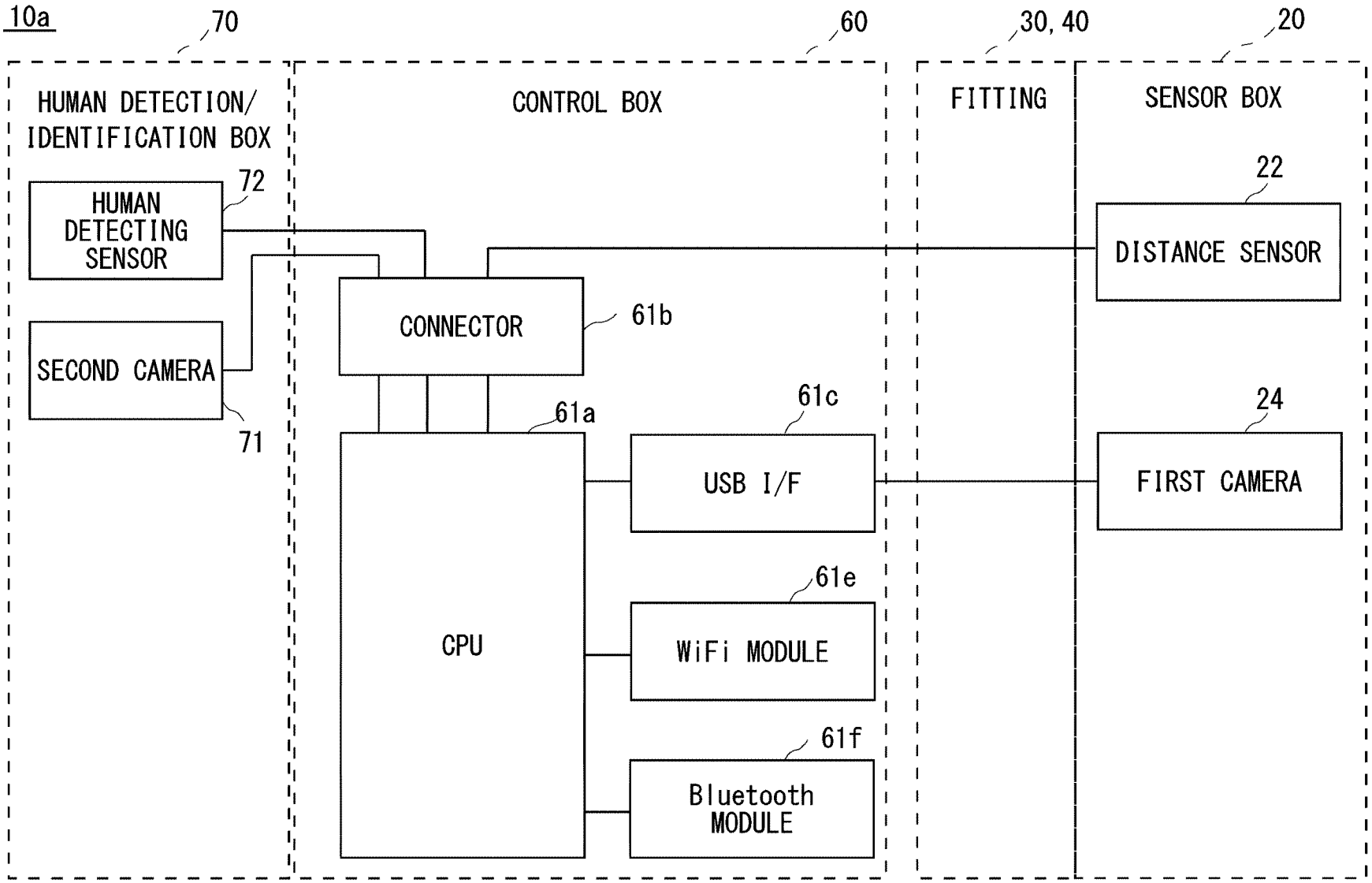
FIG. 9 is a block diagram illustrating a configuration example of the excretion information collection apparatus in FIG. 8.

The present apparatus may be referred to as an excretion information collection apparatus 10*a* illustrated in FIG. 9, and can constitute a system with a server (unillustrated) wirelessly connected to the present apparatus. Further, the system may include a terminal device (unillustrated) held by an observer of a user of a toilet, the terminal device being wirelessly connected to the server. Note that, for example, the connections may be performed within one wireless local area network (LAN). In this system, recording of an excretion, presentation (such as notification) of excretion information to the terminal device, and excretion prediction can be performed by the present apparatus, the server, and the terminal device in coordination with each other. The recording, the presentation, the prediction, and the like may be achieved by any configuration; and while description is omitted, the present apparatus can function as a toilet installation type recording-notification-excretion prediction system or an apparatus responsible for information collection for the system and may also be referred to as a toilet sensor. Further, the present apparatus may be referred to as an evacuation-urination observation apparatus and may be referred to as an evacuation-urination observation-recording apparatus when further performing information storage.

As illustrated in FIG. 9, for example, a CPU 61*a*, a connector 61*b*, a USB I/F 61*c*, a WiFi module 61*e*, and a Bluetooth module 61*f* may be stored in the control box 60 as the control unit 61. Note that USB is an abbreviation for Universal Serial Bus, and each of USB, WiFi, and Bluetooth is a registered trademark (hereinafter the same).

The CPU 61*a* is an example of a main control unit in the present apparatus and controls the entire present apparatus. The connector 61*b* connects the distance sensor 22, the second camera 71, and the human detecting sensor 72 to the CPU 61*a*. The USB I/F 61*c* connects the first camera 24 to the CPU 61*a*. Thus, the control box 60 and the sensor box 20 are connected by interfaces illustrated as the connector 61*b* and the USB I/F 61*c*, and the connecting lines are accommodated in the cable K1. Further, the control box 60 and the human detection/identification box 70 are connected by an interface illustrated as the connector 61*b*, and the connecting lines are accommodated in the cable K2.

The second camera 71 and the human detecting sensor 72 can be stored in the human detection/identification box 70. The human detecting sensor 72 is connected to the CPU 61*a* through the connector 61*b* and when detecting a person in a specific region, transmits the detection result to the CPU 61*a*. The detection result can be transmitted to the server through the WiFi module 61*e* by the CPU 61*a*. Further, receiving the detection result, the CPU 61*a* can give an image capture instruction to the second camera 71.

The second camera 71 may be an optical camera and is an example of a camera capturing a facial image of a user of a toilet and acquiring facial image data for user identification. The second camera 71 may be installed in such a way as to include the face of a user into an image capture area. The CPU 61*a* may acquire a human detection result by the human detecting sensor 72 or acquire a result of causing the server to authenticate a user by, for example, capturing an image of the face and instruct the distance sensor 22 to perform a measurement.

The distance sensor 22 and the first camera 24 can be stored in the sensor box 20. The distance sensor 22 measures the distance to a target object (the buttocks of a user of the toilet bowl 1) in accordance with an instruction from the CPU 61*a* or all the time. The CPU 61*a* acquires the measurement result and when a certain time elapses after a threshold value is exceeded, detects that the target object is sitting on the toilet seat. Further, when the distance to the target object varies after sitting on the toilet seat, the user leaving the toilet seat is detected. Further, as described in the second example embodiment, the distance sensor 22 may also be used for detection of toilet seat misalignment. The distance sensor 22 is connected to the CPU 61*a* through the connector 61*b* and can transmit a measurement result to the CPU 61*a* side. The CPU 61*a* can perform control of instructing the first camera 24 to capture an image in a stage when sitting on the seat is detected and instructing the first camera 24 to end the image capture in a stage when leaving the seat is detected.

The first camera 24 is an example of a camera capturing an image of an excretion and may be an optical camera including a lens part placed in a hole provided in the sensor box 20. The first camera 24 is installed in such a way as to include an excretion area of an excretion in the toilet bowl 1 in the toilet into an image capture area. The first camera 24 is connected to the CPU 61*a* through the USB I/F 61*c* and transmits captured image data to the CPU 61*a* side.

Further, by providing the human detection/identification box 70 at a location positioned in front when a user sits on the seat, an image of the face can be captured after sitting instead of capturing an image of the face before sitting; and in that case, the human detecting sensor 72 may be omitted.

The Bluetooth module 61*f* is an example of a receiver receiving identification data for user identification from a Bluetooth tag held by a user and may be replaced with a module based on a different short-distance communication standard. A Bluetooth tag held by a user may have an ID varying for each user and, for example, may be held by the user by being embedded in a wristband.

The WiFi module 61*e* is an example of a communication unit (communication equipment) transmitting various types of acquired data to the server and may be replaced with a module employing a different communication standard. Facial image data acquired by the second camera 71 and identification data acquired by the Bluetooth module 61*f* can be transmitted to the server through the WiFi module 61*e* by the CPU 61*a*. Further, when a user is detected to be in a sitting state, the CPU 61*a* may provide notification, through the WiFi module 61*e*, to the server, or a terminal device of an observer observing the user. Thus, use of the toilet can be notified to the observer, and the observer can be dispatched to the toilet as needed.

The CPU 61*a*, the USB I/F 61*c*, the WiFi module 61*e*, and the server acquire excretion information, based on captured image data captured by the first camera 24. In this case, main processing of acquiring excretion information from the captured image data can be performed by the server. For example, the server inputs the captured image data to a trained model and acquires excretion information. Then, for example, as at least part of the excretion information, the server acquires information indicating whether the captured image data include a foreign matter being an object other than feces and urine as a subject excluding the toilet bowl and a liquid detergent therefor.

The server receives, through the WiFi module 61*e*, facial image data acquired by the second camera 71, performs face authentication processing by comparison of, for example, keypoints between the facial image data and prestored authentication data, and acquires identification data associated with matching authentication data. Thus, the server can acquire identification data (identification data for identifying a user), in other words, can specify a user.

Then, in addition to captured image data, the server can acquire, from the present apparatus, facial image data of a user of the toilet bowl 1 when the captured image data are acquired and therefore can identify the user, based on the facial image data, and can manage excretion information for each user in an internal storage device. Further, the server can also generate presentation information for each user. Through the face authentication processing, a most approximate user can be specified as a current user of the toilet. Thus, the aforementioned identification data may be data for identifying a user by executing the face authentication processing, based on facial image data captured by the second camera 71 at the toilet bowl 1 or in a room where the toilet bowl 1 is installed (a toilet cubicle). Note that the facial image data captured by the second camera 71 are preferably not saved in consideration of privacy.

Then, the terminal device can output the presentation information for each user. Further, by predetermining one or a plurality of presentation target persons for each user (such as an observer in charge when the user is a person requiring nursing care), the server can output the presentation information to terminal devices used by the presentation target persons. While examples of an observer include a caregiver and, depending on circumstances, a doctor, a helper instead of a caregiver may also be included. Further, depending on an application environment of this system, an observer may be a different person.

Furthermore, the server receives, through the WiFi module 61*e*, identification data (personal authentication data) acquired by the Bluetooth module 61*f* and performs user authentication by comparison with prestored identification data for authentication. Note that, for example, when a caregiver holding a Bluetooth tag for the caregiver and a person requiring nursing care holding a Bluetooth tag for the person enter a toilet together, the latter may be selected as a user. Thus, the server can acquire identification data (identification data for identifying a user), in other words, can specify a user.

Then, in addition to captured image data, the server can acquire, from the present apparatus, identification data for identifying a user of the toilet bowl 1 when the captured image data are acquired and therefore can manage excretion information for each user in the internal storage device, based on the identification data. Further, the server can also generate presentation information for each user. Then, the terminal device can output the presentation information for each user. Further, by predetermining one or a plurality of presentation target persons for each user, the server can output the presentation information to terminal devices used by the presentation target persons.

Note that, a user is specified from two types of data being facial image data and identification data, and two specification functions are considered to be provided in this example; however, as a matter of course, user specification can be performed by either one. For example, both specification functions may be provided in this system, and either one may be selected during operation. Alternatively, only either specification function may be provided in this system.

Other Example Embodiments

While the information processing apparatus, the toilet bowl including the apparatus, and the server (server device) along with usage of each have been described in each example embodiment, the above is not limited to those exemplified. For example, the shape of each member in the information processing apparatus, the toilet bowl, and the toilet seat, and a positional relation between the members have only to be able to serve the functions of the members except for the particularly mentioned positional relation. Further, for example, another step may be added to a method employed in the information processing apparatus, and information to be handled is not limited to that exemplified either. Further, the toilet seat may be provided with an unillustrated lid.

Figure 10:
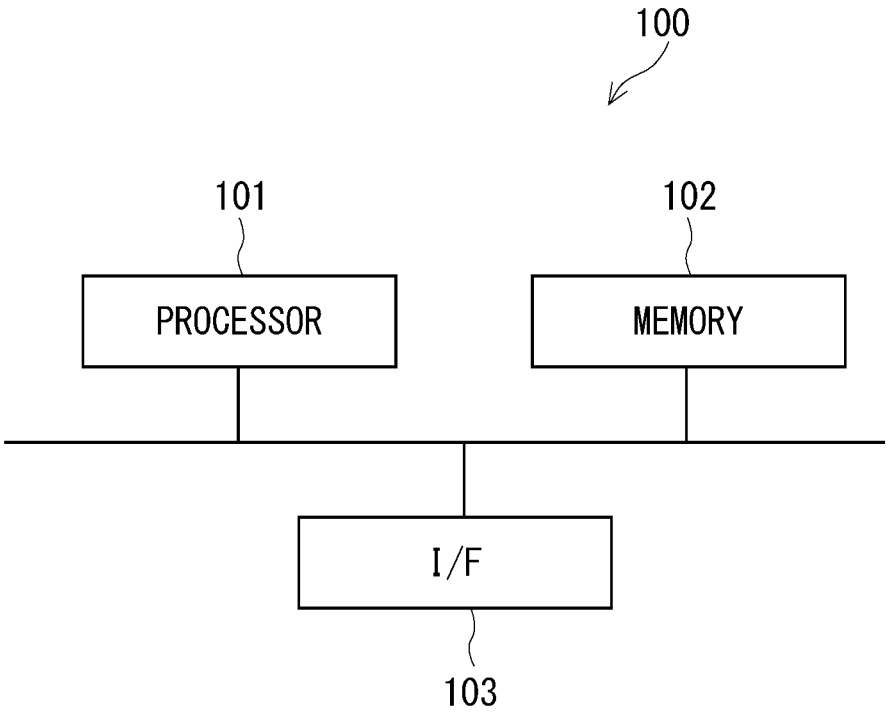
FIG. 10 is a diagram illustrating an example of a hardware configuration of an apparatus.

Further, each apparatus such as the information processing apparatus or the server described in the first to third example embodiments may have a hardware configuration as follows. FIG. 10 is a diagram illustrating an example of a hardware configuration of an apparatus.

An apparatus 100 illustrated in FIG. 10 may include a processor 101, a memory 102, and an interface (I/F) 103. For example, the processor 101 may be a microprocessor, a microprocessor unit (MPU), or a CPU. The processor 101 may include a plurality of processors. For example, the memory 102 is configured with a combination of a volatile memory and a nonvolatile memory. The function of each apparatus described in the first to third example embodiments is provided by reading and executing a program stored in the memory 102 by the processor 101. At this time, transmission and reception of information to and from another apparatus can be performed through a communication interface as the I/F 103. When the apparatus 100 is an information processing apparatus, input and output for a sensor or the like can be performed through an input-output interface as the I/F 103.

In the aforementioned example, the program includes an instruction group (or a software code) for causing a computer to perform one or more functions described in the example embodiments when being read into the computer. The program may be stored in a non-transitory computer-readable medium or a tangible storage medium. Without being limited, examples of a computer-readable medium or a tangible storage medium include a random-access memory (RAM), a read-only memory (ROM), a flash memory, a solid-state drive (SSD), or another memory technology; a CD-ROM, a digital versatile disc (DVD), a Blu-ray (registered trademark) disk, or another optical disk storage; and a magnetic cassette, a magnetic tape, a magnetic disk storage, or another magnetic storage device. The program may be transmitted on a transitory computer-readable medium or a communication medium. Without being limited, examples of a transitory computer-readable medium or a communication medium include an electric, optical, or acoustic propagation signal, or a propagation signal in another format.

Note that the present disclosure is not limited to the aforementioned example embodiments and may be modified as appropriate without departing from the scope and spirit of the present disclosure. Further, the present disclosure may be implemented by combining the example embodiments as appropriate.

The whole or part of the example embodiments disclosed above may also be described as, but not limited to, the following supplementary notes.

Supplementary Notes (Supplementary Note 1)

An information processing apparatus including:

a distance sensor configured to measure a distance to an object located in a direction of an inside of a toilet seat installed on a toilet bowl in a toilet when the toilet seat is placed on a top surface of a rim of the toilet bowl;

a housing in which the distance sensor is placed;

a fitting configured to attach the housing to the toilet bowl; and a control unit, wherein the control unit detects that a user of the toilet is in a state of sitting on the toilet seat when a first distance being a result of measurement by the distance sensor is less than a predetermined threshold value, and the fitting is a component attaching the housing in such a way that the distance sensor is placed at a position located inside the rim and located under the toilet seat in a vertical direction when the toilet seat is placed on a top surface of the rim.

(Supplementary Note 2)

The information processing apparatus according to Supplementary Note 1, wherein the control unit determines that the toilet seat is in a misaligned state when the first distance is less than another predetermined threshold value less than the predetermined threshold value.

(Supplementary Note 3)

The information processing apparatus according to Supplementary Note 1, wherein the control unit determines whether the toilet seat is in a misaligned state, based on a second distance being a result of measuring, by the distance sensor, a distance to an inner end of a bottom surface of the toilet seat when the toilet seat is placed on a top surface of the rim.

(Supplementary Note 4)

The information processing apparatus according to Supplementary Note 3, wherein the control unit changes the predetermined threshold value when determining that the toilet seat is in a misaligned state.

(Supplementary Note 5)

The information processing apparatus according to any one of Supplementary Notes 1 to 4, further including a communication unit, wherein the control unit provides notification, through the communication unit, to a server, or a terminal device of an observer observing the user when detecting that the user is in a sitting state.

(Supplementary Note 6)

The information processing apparatus according to any one of Supplementary Notes 1 to 5, further including an information collection unit configured to be controlled by the control unit and collect information about an excretion in the toilet bowl, wherein the information collection unit is placed in the housing.

(Supplementary Note 7)

The information processing apparatus according to any one of Supplementary Notes 1 to 6, wherein the fitting includes an extension part shaped along an inner wall forming an inside of the rim, and the housing is attached to a tip of the extension part.

(Supplementary Note 8)

An information processing method including:

measuring, by a distance sensor, a distance to an object located in a direction of an inside of a toilet seat installed on a toilet bowl in a toilet when the toilet seat is placed on a top surface of a rim of the toilet bowl in a state of attaching, by a fitting, a housing in which the distance sensor is placed in such a way that the distance sensor is placed at a position located inside the rim and located under the toilet seat in a vertical direction when the toilet seat is placed on a top surface of the rim; and detecting that a user of the toilet is in a state of sitting on the toilet seat when a first distance being a result of measurement by the distance sensor is less than a predetermined threshold value.

(Supplementary Note 9)

The information processing method according to Supplementary Note 8, further including determining that the toilet seat is in a misaligned state when the first distance is less than another predetermined threshold value less than the predetermined threshold value.

(Supplementary Note 10)

The information processing method according to Supplementary Note 8, further including determining whether the toilet seat is in a misaligned state, based on a second distance being a result of measuring, by the distance sensor, a distance to an inner end of a bottom surface of the toilet seat when the toilet seat is placed on a top surface of the rim.

(Supplementary Note 11)

The information processing method according to Supplementary Note 10, further including changing the predetermined threshold value when determining that the toilet seat is in a misaligned state.

(Supplementary Note 12)

The information processing method according to any one of Supplementary Notes 8 to 11, further including collecting information about an excretion in the toilet bowl by an information collection apparatus placed in the housing.

(Supplementary Note 13)

A program causing a computer to execute processing of:

receiving a first distance being a result of measuring, by a distance sensor, a distance to an object located in a direction of an inside of a toilet seat installed on a toilet bowl in a toilet when the toilet seat is placed on a top surface of a rim of the toilet bowl in a state of attaching, by a fitting, a housing in which the distance sensor is placed, in such a way that the distance sensor is placed at a position located inside the rim and located under the toilet seat in a vertical direction when the toilet seat is placed on a top surface of the rim; and detecting that a user of the toilet is in a state of sitting on the toilet seat when the first distance is less than a predetermined threshold value.

(Supplementary Note 14)

The program according to Supplementary Note 13, further causing the computer to execute processing of determining that the toilet seat is in a misaligned state when the first distance is less than another predetermined threshold value less than the predetermined threshold value.

(Supplementary Note 15)

The program according to Supplementary Note 13, further causing the computer to execute processing of:

receiving a second distance being a result of measuring, by the distance sensor, a distance to an inner end of a bottom surface of the toilet seat when the toilet seat is placed on a top surface of the rim; and determining whether the toilet seat is in a misaligned state, based on the second distance.

(Supplementary Note 16)

The program according to Supplementary Note 15, further causing the computer to execute processing of changing the predetermined threshold value when determining that the toilet seat is in a misaligned state.

(Supplementary Note 17)

The program according to any one of Supplementary Notes 13 to 16, further causing the computer to execute processing of receiving information about an excretion in the toilet bowl, the information being collected by an information collection apparatus placed in the housing.

While the present invention has been described above with reference to the example embodiments, the present invention is not limited to the aforementioned example embodiments. Various changes and modifications that may be understood by a person skilled in the art may be made to the configurations and details of the present invention without departing from the scope of the present invention.

This application claims priority based on Japanese Patent Application No. 2021-140225 filed on Aug. 30, 2021, the disclosure of which is hereby incorporated by reference thereto in its entirety.

REFERENCE SIGNS LIST

1 TOILET BOWL
1*a* SIDE
1*b* PLANE PART
1*c* RIM
1*d* RESERVOIR PART
1*e* ATTACHMENT PART
2 TOILET SEAT
2*a* ATTACHMENT PART
2*b* TOILET SEAT BODY
2*c* PROJECTING PART
10 INFORMATION PROCESSING APPARATUS
10*a* EXCRETION INFORMATION COLLECTION APPARATUS
20 SENSOR BOX (SENSOR UNIT)
21 HOUSING (INNER HOUSING)
22 DISTANCE SENSOR
23 PLACEMENT PART
24 INFORMATION COLLECTION UNIT (FIRST CAMERA)
25 TRANSPARENT PART
26 CORD
30, 40 FITTING
41 TIP
41*a*, 43*g* ELASTIC MEMBER
42 BRIDGING PART
43 OUTER HOUSING
43*a* HOUSING BODY
43*c* SLIDING MEMBER
43*d* STORAGE PART
43*e* SLIDE GROOVE
43*f* DIAL KNOB
60 CONTROL BOX
61 CONTROL UNIT
61*a* CPU
61*b* CONNECTOR
61*c* USB I/F
61*e* WIFI MODULE
61*f* BLUETOOTH MODULE
70 HUMAN DETECTION/IDENTIFICATION BOX
71 IMAGE CAPTURE APPARATUS (SECOND CAMERA)
72 HUMAN DETECTING SENSOR
100 APPARATUS
101 PROCESSOR
102 MEMORY
103 I/F
K1, K2 CABLE
U USER
Ub BUTTOCKS OF USER

What is claimed is:

1. An information processing apparatus comprising:

a distance sensor configured to measure a distance to an object located in a direction of an inside of a toilet seat installed on a toilet bowl in a toilet when the toilet seat is placed on a top surface of a rim of the toilet bowl;

a housing in which the distance sensor is placed;

a fitting configured to attach the housing to the toilet bowl;

at least one memory storing instructions; and at least one processor configured to execute the instructions to detect that a user of the toilet is in a state of sitting on the toilet seat when a first distance being a result of measurement by the distance sensor is less than a predetermined threshold value, wherein the fitting is a component attaching the housing in such a way that the distance sensor is placed at a position located inside the rim and located under the toilet seat in a vertical direction when the toilet seat is placed on a top surface of the rim.

2. The information processing apparatus according to claim 1, wherein the at least one processor is configured to execute the instructions to determine that the toilet seat is in a misaligned state when the first distance is less than another predetermined threshold value less than the predetermined threshold value.

3. The information processing apparatus according to claim 1, wherein the at least one processor is configured to execute the instructions to determine whether the toilet seat is in a misaligned state, based on a second distance being a result of measuring, by the distance sensor, a distance to an inner end of a bottom surface of the toilet seat when the toilet seat is placed on a top surface of the rim.

4. The information processing apparatus according to claim 3, wherein the at least one processor is configured to execute the instructions to change the predetermined threshold value when determining that the toilet seat is in a misaligned state.

5. The information processing apparatus according to claim 1, further comprising a communicator, wherein the at least one processor is configured to execute the instructions to provide notification, through the communicator, to a server, or a terminal device of an observer observing the user when detecting that the user is in a sitting state.

6. The information processing apparatus according to claim 1, further comprising an information collector configured to be controlled by the at least one processor and collect information about an excretion in the toilet bowl, wherein the information collector is placed in the housing.

7. The information processing apparatus according to claim 1, wherein the fitting includes an extension part shaped along an inner wall forming an inside of the rim, and the housing is attached to a tip of the extension part.

8. An information processing method comprising:

measuring, by a distance sensor, a distance to an object located in a direction of an inside of a toilet seat installed on a toilet bowl in a toilet when the toilet seat is placed on a top surface of a rim of the toilet bowl in a state of attaching, by a fitting, a housing in which the distance sensor is placed, in such a way that the distance sensor is placed at a position located inside the rim and located under the toilet seat in a vertical direction when the toilet seat is placed on a top surface of the rim; and detecting that a user of the toilet is in a state of sitting on the toilet seat when a first distance being a result of measurement by the distance sensor is less than a predetermined threshold value.

9. The information processing method according to claim 8, further comprising determining that the toilet seat is in a misaligned state when the first distance is less than another predetermined threshold value less than the predetermined threshold value.

10. The information processing method according to claim 8, further comprising determining whether the toilet seat is in a misaligned state, based on a second distance being a result of measuring, by the distance sensor, a distance to an inner end of a bottom surface of the toilet seat when the toilet seat is placed on a top surface of the rim.

11. The information processing method according to claim 10, further comprising changing the predetermined threshold value when determining that the toilet seat is in a misaligned state.

12. The information processing method according to claim 8, further comprising collecting information about an excretion in the toilet bowl by an information collection apparatus placed in the housing.

13. A non-transitory computer-readable medium on which a program is stored, the program causing a computer to execute processing of:

receiving a first distance being a result of measuring, by a distance sensor, a distance to an object located in a direction of an inside of a toilet seat installed on a toilet bowl in a toilet when the toilet seat is placed on a top surface of a rim of the toilet bowl in a state of attaching, by a fitting, a housing in which the distance sensor is placed, in such a way that the distance sensor is placed at a position located inside the rim and located under the toilet seat in a vertical direction when the toilet seat is placed on a top surface of the rim; and detecting that a user of the toilet is in a state of sitting on the toilet seat when the first distance is less than a predetermined threshold value.

14. The non-transitory computer-readable medium according to claim 13, further causing the computer to execute processing of determining that the toilet seat is in a misaligned state when the first distance is less than another predetermined threshold value less than the predetermined threshold value.

15. The non-transitory computer-readable medium according to claim 13, further causing the computer to execute processing of:

receiving a second distance being a result of measuring, by the distance sensor, a distance to an inner end of a bottom surface of the toilet seat when the toilet seat is placed on a top surface of the rim; and determining whether the toilet seat is in a misaligned state, based on the second distance.

16. The non-transitory computer-readable medium according to claim 15, further causing the computer to execute processing of changing the predetermined threshold value when determining that the toilet seat is in a misaligned state.

17. The non-transitory computer-readable medium according to claim 13, further causing the computer to execute processing of receiving information about an excretion in the toilet bowl, the information being collected by an information collection apparatus placed in the housing.

* * * * *